United States Patent [19]

Huydts

[11] Patent Number: 4,523,521

[45] Date of Patent: Jun. 18, 1985

[54] SPINDLE PRESS

[75] Inventor: Eduard J. C. Huydts, Düsseldorf, Fed. Rep. of Germany

[73] Assignee: G. Siempelkamp GmbH & Co., Krefeld, Fed. Rep. of Germany

[21] Appl. No.: 533,198

[22] Filed: Sep. 16, 1983

[30] Foreign Application Priority Data

Sep. 17, 1982 [DE] Fed. Rep. of Germany ..... 3234520

[51] Int. Cl.[3] ..... B30B 1/18

[52] U.S. Cl. ..... 100/259; 100/289

[58] Field of Search ..... 100/259, 289, 290; 188/300; 267/64.12; 72/431, 432

[56] References Cited

U.S. PATENT DOCUMENTS 2,857,157 10/1958 Bonquet ..... 100/259 X
4,030,336 6/1977 Grigorenko et al. ..... 72/432
4,207,763 6/1980 Huydts et al. ..... 100/289 X

FOREIGN PATENT DOCUMENTS 2851551 6/1980 Fed. Rep. of Germany .
1253404 11/1971 United Kingdom ..... 100/289
0569456 8/1977 U.S.S.R. ..... 100/289

*Primary Examiner*—Billy J. Wilhite
*Attorney, Agent, or Firm*—Karl F. Ross; Herbert Dubno

[57] ABSTRACT

A spindle press in which a lubricant is displaced by relative movement of the threaded spindle and the ram displaced thereby, at least on a return stroke of the ram effected by a fluid operated jack. According to the invention, the press is provided with a control piston which blocks the lubricant flow as the ram approaches a deadpoint position at the end of its return stroke so as to enable the lubricant trapped between the spindle and the ram to damp the end of the return stroke.

4 Claims, 4 Drawing Figures

SPINDLE PRESS

FIELD OF THE INVENTION

My present invention relates to a spindle press and, more particularly, a press of the type in which a threaded spindle is rotated to drive a pressing ram against a workpiece and the workpiece against an anvil or support surface or structure. More particularly, the invention relates to improvements in a spindle press of this type which utilizes a lubricant which is in part displaced upon relative movement of the spindle and the ram.

BACKGROUND OF THE INVENTION

From German patent document (Open Application) DE-OS No. 28 51 551 and other publications, it is known to provide a spindle press which comprises a press frame or support, a spindle rotatable on this support and having a threaded portion, a ram provided with a nut coupling the ram with the spindle and means, e.g. a piston-and-cylinder arrangement or jack for effecting a return stroke of the ram relative to the press support.

It is also known, when such a return stroke jack is provided, to also utilize a return stroke damping device which is effective to prevent the generation of a sudden shock when the ram reaches its return limiting position.

As noted, the spindle is coupled by a spindle nut to the ram.

In such systems in which a lubricant is provided, the ram can be formed as a hollow structure within which the lubricant is displaced by the relative movement of the ram and the spindle with the flow of lubricant between the end of the ram and the end of the spindle being controlled by a throttle to ensure that the lubricant will effectively pass between the surfaces of the internal thread of the nut and the external thread of the spindle.

The lubricant thereby obtains, via the throttle arrangement, a sufficient back pressure to ensure lubrication of the slidably engaging surfaces. This lubrication of the thread coupling the spindle to the ram in such prior art devices is the exclusive purpose of the throttle arrangement.

Consequently, where a return stroke is provided, e.g. by jacks in the manner described, a separate arrangement has been utilized for damping or slowing the return stroke at least toward the end of this stroke.

In other words, to damp the return stroke of the ram, a separate return stroke damping device was provided, utilizing conventional-pot dampers externally engaging or coupled with the ram and braced against the press support. This damping cylinder is positioned to become effective just before the ram reaches its upper deadpoint position.

Experience has shown that with rapid cycling of the press, these damping cylinders become unduly heated, thereby reducing their useful life and requiring maintenance expense and down time for the apparatus.

Furthermore, the setting of the upper deadpoint position and the setting of the damping cylinders requires separate means, thereby increasing the complexity of the apparatus.

OBJECTS OF THE INVENTION

It is the principal object of the present invention to provide an improved spindle press with return stroke damping which overcomes the drawbacks of earlier systems and, especially, is free from the problem which arises with conventional damping cylinder arrangements upon overheating.

Another object of this invention is to provide a spindle press of the aforedescribed type which is capable of ensuring effective and defined return stroke damping even at high cycling rates and, moreover, which is capable of providing a well defined upper deadpoint position for the ram.

SUMMARY OF THE INVENTION

These objects and others which will become apparent hereinafter are attained, in accordance with the invention, by providing, in a spindle press of the aforedescribed type, having a press support, a spindle rotatably mounted on the support, means for driving the threaded spindle, a ram coupled by a nut to the spindle and provided with a hollow interior into which the spindle extends for displacement of a lubricant in the ram, and return stroke piston-and-cylinder arrangements (jacks), which also utilizes the throttle device for the lubricant as a return stroke damping element and, more particularly, includes a control piston which is responsive to or operated by the return stroke for closing the throttle shortly before the ram reaches its upper deadpoint position and thereby generate the return stroke damping effect. According to the present invention, the lubricant flows during the return stroke through the throttle arrangement which is so dimensioned that it can also function as a return stroke damping element.

Shortly before the ram reaches its upper deadpoint position, the throttle element is closed by the aforementioned control piston which can become effective at a well defined upper deadpoint position for the ram, e.g. by engagement of this control piston with a fixed abutment of the press support.

The lubricant in the ram compartment or interior can thus undergo, after closure of the throttle element, a limited compression, thereby absorbing residual ram energy in a damping action without affecting the defined upper deadpoint position.

It, of course, will be understood that the ram interior must provide a lubricant supply compartment from which the lubricant flows and of a lubricant volume, taken with the volume of the receptacle receiving the lubricant, that a detrimental heating of the lubricant does not occur. The lubricant is usually conventional lubricating oil.

The throttle element can have various constructions within the scope of the present invention. For example, in one embodiment characterized by simplicity and reliability in spindle press applications in the sense that its action is reproducible for each cycle as is important for mass production applications of the press, the throttle element comprises a throttle cylinder receiving the control piston which can be formed with or can provide a flow passage which can communicate with a port in the throttle cylinder connected with the lubricant bore running to the ram interior, on the one hand, and on the other hand can communicate with a lubricant passage running to a lubricant supply chamber or reservoir, the communication with the ram interior being controlled by the piston and closed shortly before the ram reaches its upper deadpoint position.

The throttle cylinder can be mounted in a lower portion of the ram and the control piston can project upwardly therefrom and can be spring biased in the upward direction so that, as the ram rises, it can engage a return stroke abutment on the press support. The latter can be adjustable on the press frame and the lubricant reservoir can surround the ram, thereby providing an especially compact construction.

It has also been found to be advantageous, in another embodiment of the invention, to provide the throttle arrangement so that its throttle effect can be adjusted externally of the press, e.g. manually, to permit the press operation to be accommodated to different operating conditions and requirements. For example, the throttle device can comprise a throttle cylinder bore within which two nested throttle cylinder sleeves can be provided. The nested sleeves can define the throttle passage so that by relative rotation of the sleeves, the passage can be selectively blocked at least at its communication with the lubricant passage. The throttle bore in the outer cylindrical sleeve can register with a distribution passage and a control piston can be provided for the throttle bore of the inner sleeve, this piston having a bore connecting chambers or compartments above and below the valve member of the control piston and being engageable with a return stroke limiting abutment on the press frame. In this embodiment as well, the position of the return stroke abutment or stop can be adjusted.

The most significant advantage of the system of the invention is that no special damping cylinder is required on the ram or elsewhere to take up the energy of the return stroke of the ram. The spindle at its lower end can act as a control piston to cooperate with the lubricant bore communicating with the throttle to accomplish a similar purpose. This embodiment has been found to be especially effective when the throttle cooperates with an additional throttle valve which can be controlled externally of the press.

Even without the damping cylinders of the prior art, the system of the invention can operate with rapid cycling rates, providing a well defined and effective return stroke damping, without detrimental lubricant heating and with reasonably precise positioning of the upper deadpoint position which can be adjustable in the manner described.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
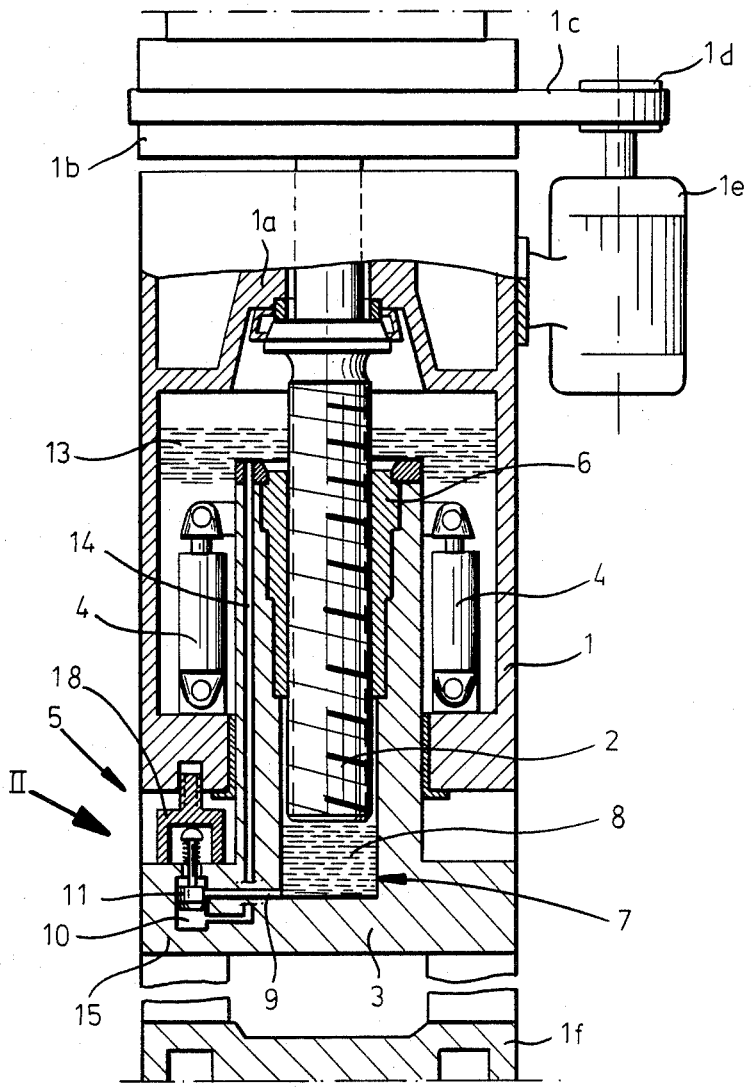
FIG. 1 is a vertical (axial) cross sectional view diagrammatically showing a spindle press according to the present invention.
Figure 2:
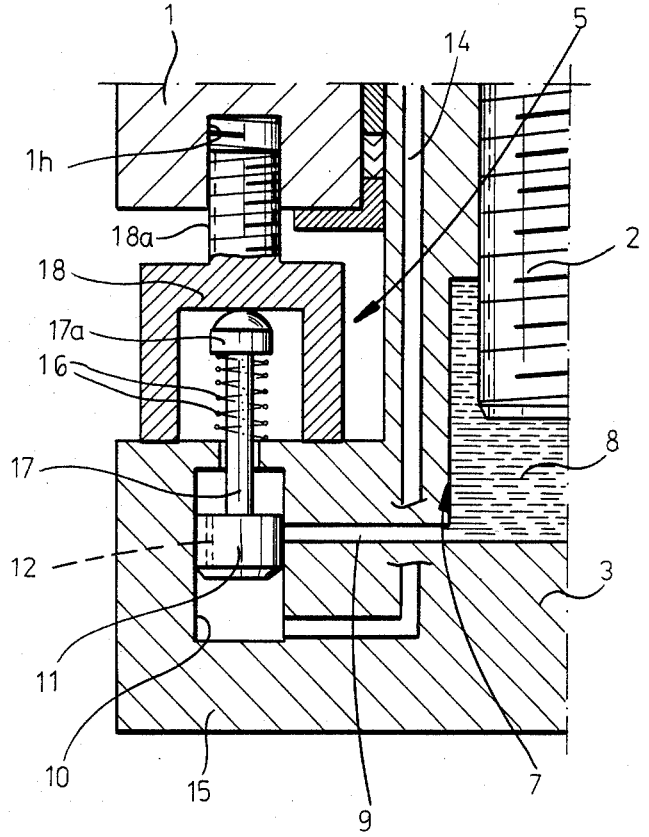
FIG. 2 is an enlarged detail view of the region II of FIG. 1.

The spindle press shown in FIGS. 1 and 2 comprises a press frame or support 1 in which a spindle 2 is journaled, e.g. via a bearing represented at 1*a* and can be connected to a pulley 1*b* by a unirotational clutch (not shown), the pulley 1*b* being driven by a belt 1*c* from the drive pulley 1*d* of a motor 1*e* mounted upon the press frame.

The unirotational clutch allows coupling of the spindle to the pulley 1*b* to drive the ram 3 downwardly by rotation via the motor 1*e*, but releases the spindle 2 for free rotation during the upstroke of the ram 3, i.e. the return stroke via the piston-and-cylinder arrangements or jacks 4.

The return stroke damping device of the present invention has been represented generally at 5 and the ram 3 is juxtaposed with an anvil 1*f* against which the workpiece can be driven by its engagement by the ram 3.

The spindle 2 threadedly engages a spindle nut 6 which is connected to the ram 3 and extends into a compartment or chamber 7 formed in the hollow interior of the ram.

The chamber 7 is filled with a liquid lubricant 8 which can flow into the chamber 7 or out of the chamber 7 depending upon the direction of displacement of the ram 3 and its relative movement with respect to the spindle 2, via the lubricant bore 9.

The lubricant flow is controlled by a throttle device represented at 10. In all embodiments of the invention the throttle device 10 also forms the return stroke damper 5. In the embodiment of FIGS. 1 and 2, the return stroke damping device also comprises a control piston 11 which is displaced in dependence upon the return stroke and hence is a return stroke dependent control piston which becomes effective shortly before the ram 3 reaches its upper deadpoint position.

In the embodiment of FIGS. 1 and 2, moreover, the lubricant flow from the space 7 via the bore 9 is throttled and then cut off to establish the upper deadpoint position of the ram 3.

The throttle device 10 comprises a throttle cylinder in which the control piston 11 is vertically displaceable. This piston 11 is formed with a bypass passage 12. The lubricant bore 9 opens into the cylinder 10 (FIG. 2) and a lubricant passage 14, which communicates with the lubricant reservoir 13, also opens into the cylinder 10.

The cylinder 10 is provided in a lower body 15 of the ram 3 and the control piston 11 has a piston rod 17 projecting upwardly from this body and slidable therein. A head 17*a* on the piston rod 17 forms one seat for a compression spring 16 which is braced upon the member 15 and urges the piston 11 into an upper position in which communication between the passages 9 and 14 is permitted until the head 17*a* engages an abutment 18. The latter can directly encounter member 15 to form a fixed stop for the upper deadpoint position of the ram and the head 17*a* can engage the abutment 18 shortly before this upper deadpoint position to block the port 9.

The position of the abutment 18 can be adjusted by rotating it, since it has a threaded shank 18*a* received in a threaded bore 1*h* of the press support 1.

The damping action on the return stroke thus is effected simply by closing the port 9 shortly before the ram 3 reaches its upper deadpoint position, thereby generating a closed space between the spindle and ram at the lower end of the latter in which the lubricant 8 is compressed.

Figure 3:
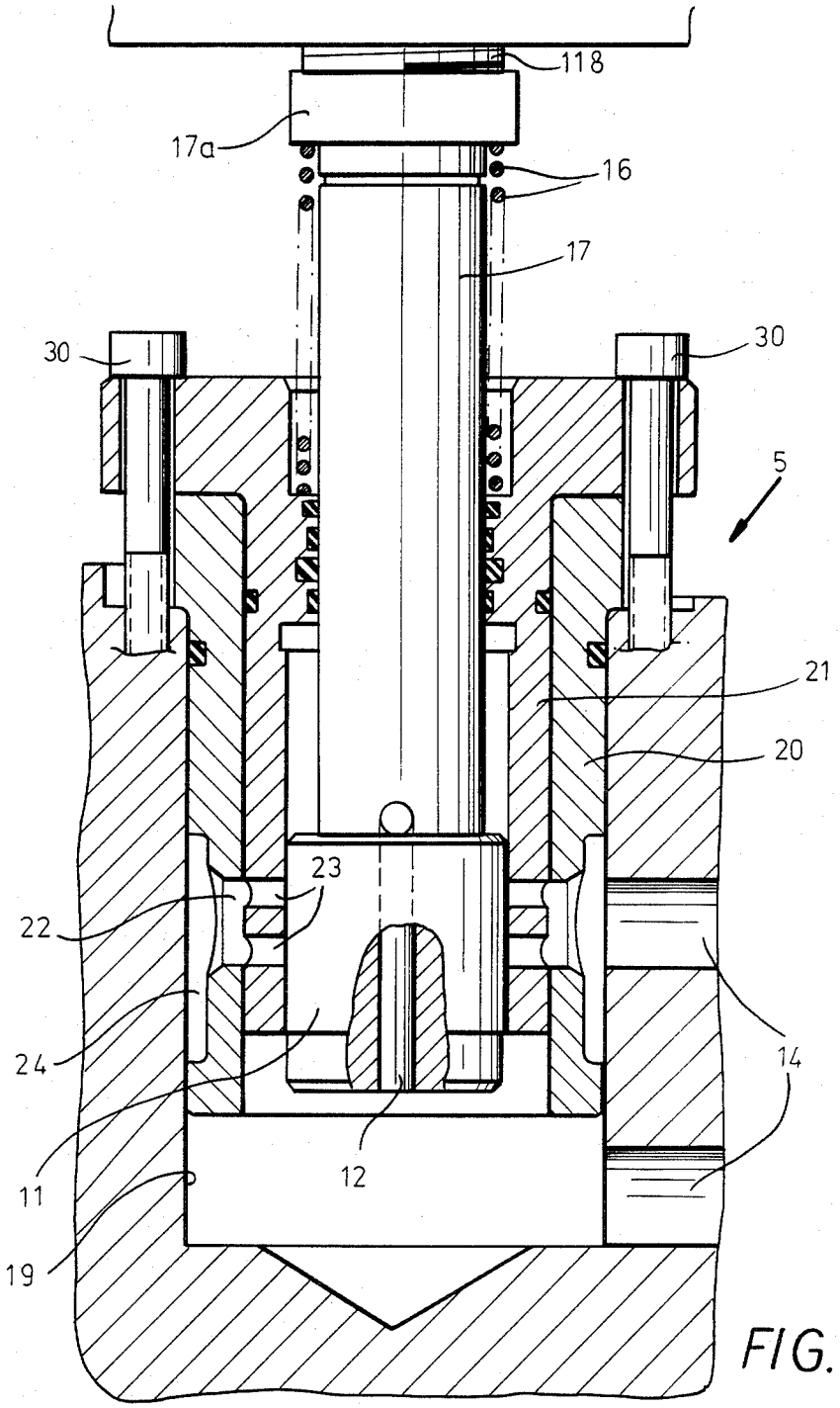
FIG. 3 is a view similar to FIG. 2 illustrating another embodiment of a throttle arrangement for spindle press according to the invention.

It has been found to be advantageous to enable the throttle device 5 to be adjusted externally of the press. A throttle device 5 for this purpose, which can be utilized with the press of FIG. 1, has been shown in FIG. 3. In this case, the throttle cylinder 19 receives two cylinder sleeves 20 and 21 which can be rotated relatively and are nested. These sleeves are provided with throttle bores 22 and 23 which can be mutually offset by rotation of the sleeves to vary the throttle effect. The positions of the sleeves can then be fixed by the tightening of the screws 30.

The cylinder 19 is provided in the lubricant passage 14 and thus the throttle effect is applied to the flow in both directions along this passage.

The throttle bores 22 of the outer sleeve 20 communicate with a distribution passage 24. In this embodiment as well, a control piston 11 is provided which operates in the manner described in FIGS. 1 and 2 as a closure for the lubricant line when the piston rod 17 engages an abutment 118 which can have a screw adjustment on the press frame. The spring 116 here bears against a head 17*a* of the piston rod 17 in the manner described.

Figure 4:
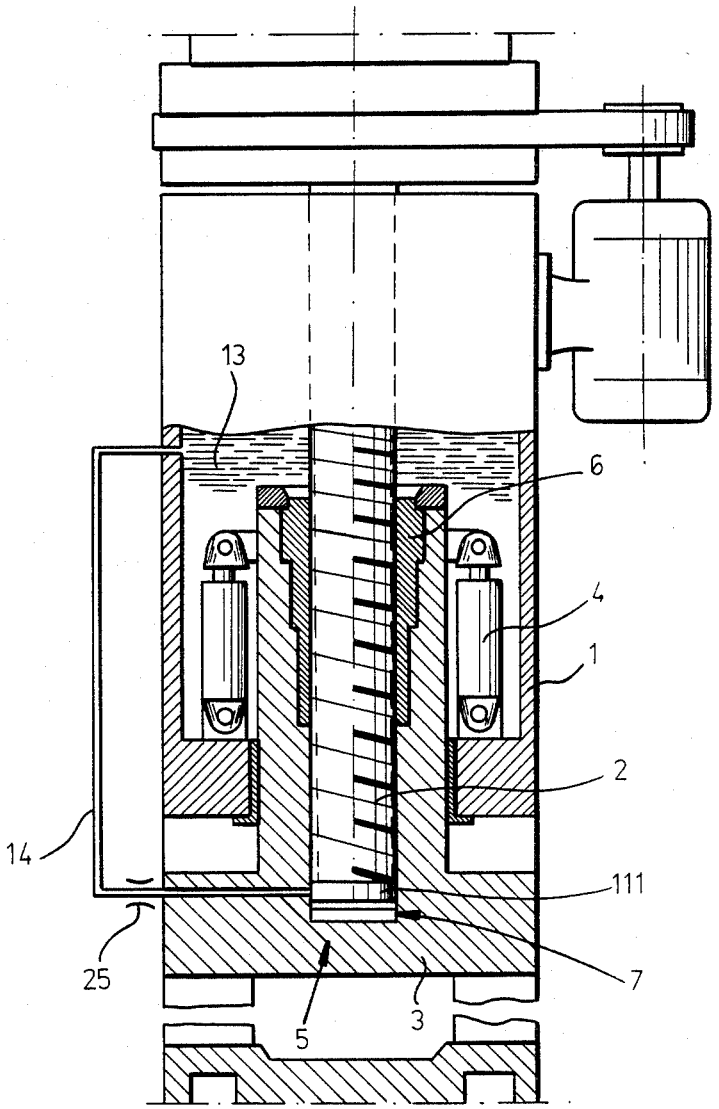
FIG. 4 is a view similar to FIG. 1 showing another embodiment of a spindle press.

A further embodiment of the invention is shown in FIG. 4 from which it will be apparent that the lower end of the spindle 2 can be formed as the control piston 111 to block the lubricant line 14 which can be provided with an externally adjustable throttle 25. The control piston 111 is positioned so that the lubricant line 14 has closed shortly before the ram 3 reaches its upper deadpoint position.

I claim:

1. A spindle press comprising:

an upright press support;

a ram mounted on said support for vertical movement thereon;

a spindle threadedly engaging said ram for displacing same on said support in one direction upon driven rotation of said spindle, said support being hollow and formed with a lubricant-containing internal compartment, said spindle extending into said compartment; and at least one return jack connecting said ram with said support for displacing said ram in the opposite direction in a return stroke, said ram having a lubricant passage through which lubricant is displaced into and out of said compartment by relative movement of said spindle and said ram, a throttle being connected with said passage for restricting flow therealong, said throttle being disposed on a lower portion of said ram and including a piston for blocking said passage upon said ram approaching a deadpoint position in a return stroke, whereby lubricant trapped between said spindle and said ram damps the termination of said return stroke, said passage being formed with a throttle cylinder receiving said piston and said piston being provided with a bypass passage, a lubricant bore communicating between said cylinder and said compartment and a further bore communicating between said cylinder and a reservoir for said lubricant, said piston being positioned to block at least one of said bores upon movement of said ram into a position close to said deadpoint position, said pistpn projecting upwardly from said portion of said ram toward a portion of said support, said portion of said support being provided with an adjustable abutment engaging said piston as said ram spproaches its deadpoint position.

2. The press defined in claim 1 wherein said abutment is threaded in said portion of said support enabling it to be adjusted relative thereto.

3. The press defined in claim 1 wherein said compartment surrounds said spindle and said ram on said support.

4. The press defined in claim 1 further comprising means for adjusting said throttle from a location externally of the press.

* * * * *